United States Patent [19]

Kline

[11] Patent Number: 5,033,245

[45] Date of Patent: Jul. 23, 1991

[54] ARCHITECTURAL BUILDING BLOCK

[75] Inventor: James R. Kline, Petoskey, Mich.

[73] Assignee: Glass Alternatives Corp., Petoskey, Mich.

[21] Appl. No.: 511,284

[22] Filed: Apr. 20, 1990

Related U.S. Application Data

[63] Continuation-in-part of Ser. No. 464,948, Jan. 16, 1990.

[51] Int. Cl.[5] ..... E04B 5/46

[52] U.S. Cl. ..... 52/306; 52/308

[58] Field of Search ..... 52/306, 308, 307, 590, 52/591, 309.1; 40/312, 541, 545, 552, 553, 564, 570, 574, 584, 606, 661

[56] References Cited

U.S. PATENT DOCUMENTS

| | | | |
|---|---|---|---|
| 2,318,362 | 7/1942 | Boeglen et al. | 52/308 |
| 4,058,943 | 11/1977 | Sturgill | 52/307 X |
| 4,628,652 | 12/1986 | Wefels | 52/593 X |
| 4,891,925 | 1/1990 | Carlson et al. | 52/586 X |

*Primary Examiner*—David A. Scherbel

*Assistant Examiner*—L. Watson

*Attorney, Agent, or Firm*—Mason, Kolehmainen, Rathburn & Wyss

[57] ABSTRACT

An architectural building block is formed of light transmitting, molded plastic material to resemble a common glass block or brick and comprises a pair of halves joined together along a seam to form a hollow block with the seam spaced intermediately between a pair of opposite planar outer side walls of the block. Each half has an inner surface and an outer surface comprising one of the outer side walls of the block integrally joined around its periphery to an inwardly directed peripheral edge wall having a plurality of planar wall segments and having a continuous free edge providing one joining edge of the seam. Integrally formed snap lock connectors are provided adjacent each corner of the block for interconnecting an adjacent block laid up in a wall structure and a flange structure is formed along each wall segment between the connectors providing a surface for backing up joint adhesive applied between adjacent wall segments of laid up blocks.

17 Claims, 4 Drawing Sheets

ARCHITECTURAL BUILDING BLOCK

This application is a continuation-in-part of copending U.S. Pat. application Ser. No. 07/464,948, filed Jan. 16, 1990.

BACKGROUND OF THE INVENTION

1. Field of the Invention

The present invention relates to architectural building blocks and more particularly to a new and improved lightweight, architectural building block formed of light transmitting, molded plastic material having a thin, hard, transparent, abrasion resistant surface coating of plastic resin permanently bonded on at least one side face of the block.

The lightweight, molded plastic building block of the present invention provides a number of important features and advantages over conventional glass building blocks and these features include: (1) weight reduction of 50% to 75%; (2) high impact resistance against external and internal forces; (3) the plastic block is nearly indestructible in normal or abusive situations; (4) some 250 times stronger than an ordinary glass block; (5) 20% to 30% improved thermal efficiency over that of a glass block; (6) an optical quality equal to or better than that of a glass block; (7) provides increased security and safety; able; (9) detachable snap lock connector assemblies eliminate the need for skilled labor in assembling or building structures made up of the blocks; (10) RTV silicone and other adhesives can be utilized in place of conventional mortar joints, thereby eliminating the need for special tools and masonry skills; (11) decorative features including relatively low cost interior surfaces of gold, silver and other metals can be provided easily by vacuum deposition, sputtering, etc.; (12) unlimited graphics and indicia are readily obtainable in molded form on outer surfaces including company logos, initials, special designs and shapes which can be economically produced; and (13) the interior of the block is readily illuminated for decorative and/or security needs.

A new and improved building block of the present invention additionally provides advantageous features which include (1) a building block that is truly adhesively coupled with the other blocks in a wall structure, (2) a building block that can be sawed, nailed, glued and screwed with ordinary woodworking tools and adhesives, (3) a building block which can form a wall structure over 8 feet high without the need for reinforcement or other supports, and (4) a building block which can be laid up in place rapidly and accurately with relatively unskilled labor.

A new and improved architectural building block in accordance with the present invention is produced in a low stress, injection molding process of the type more fully described and set forth in copending U.S. Pat. application Ser. No. 07/389,338, filed Aug. 3, 1989 for A PANEL AND METHOD OF MAKING THE SAME, which patent application is hereby incorporated herein by reference.

2. Background of the Prior Art

Over the years, a wide variety of architectural building blocks commonly known as glass blocks or glass bricks have been developed for use in exterior walls, interior walls and/or other types building structures. Austrian Patent Nos. 169151 and 183209, Belgian Patent No. 567594, Canadian Patent No. 712300, French Patent Nos. 1155005, No. 1186063, No. 1196461 and No. 1341653 and U.S. Pat. Nos. 951,010, 2,170,602, 2,194,756, 3,387,421, 3,422,588, 3,438,165, 3,798,861, 3,954,326, 4,004,392, 4,628,652 and 4,852,321 generally disclose glass blocks or glass bricks used for buildings and the like, having one or more drawbacks in that they are relatively heavy, easy to break, low in strength, easily damaged and have generally poor heat insulating or heat transfer characteristics.

OBJECTS OF THE PRESENT INVENTION

It is an object of the present invention to provide a new and improved architectural building block, and more particularly, a new and improved architectural building block formed of light transmitting, molded plastic material.

More specifically, it is an object of the present invention to provide a new and improved architectural building block of the character described having a number of important advantageous features as previously set forth herein which provide distinct advantages over common glass blocks or glass bricks now available.

Still another object of the present invention is to provide a new and improved light transmitting building block of molded plastic material which utilizes silicones or other adhesives in place of mortar joints and thus eliminates special tools and masonry skills previously required for glass blocks.

Another object of the invention is to provide a new and improved light transmitting building block which can be rapidly assembled together with adjacent blocks and held in place with detachable snap locks and thereafter adhesively secured together by modern adhesive sealants.

Yet another object of the invention is to provide a new and improved building block of the character described which can be sawed, planed, sanded, nailed, glued and screwed with ordinary woodworking tools to provide flat, curved and corner wall structures of strength and beauty.

BRIEF SUMMARY OF THE PRESENT INVENTION

The foregoing and other objects and advantages of the present invention are accomplished in a new and improved decorative architectural building block formed of light transmitting, molded plastic material generally resembling a glass block or glass brick. The new and improved plastic building block comprises a plurality of halves joined together along a seam to form a hollow block enclosure with the seam joint spaced intermediately between a pair of opposite outer side faces of the block.

Each half includes a continuous molded inner surface and has an outer surface comprising one of the outer side faces of the block which is integrally joined around its periphery to an inwardly directed continuous peripheral wall having a free edge providing one joining edge of the seam joint. The opposite outer side faces of the block are normally surfaced with a permanent, thin, hard, transparent, abrasion, chemical and ultraviolet light resistant protective coating layer of plastic resin which may be tinted as desired to provide a wide variety of color effects.

The peripheral wall of each half comprises a plurality of planar wall segments forming corners of the block and snap lock connectors are provided adjacent the corners on each wall segment for interconnecting blocks together and maintaining parallel spacing between adjacent wall segments of adjacent blocks. Flanges are provided between the connectors on the corners to provide a backing surface for receiving fluid adhesives applied to secure the adjacent blocks together permanently. Openings are formed between the flanges of a block and between flanges of adjacent blocks permitting some adhesive material to penetrate to the inside surfaces of the flanges and provide a positive, adhesively locking bond between the blocks.

BRIEF DESCRIPTION OF THE DRAWINGS

For a better understanding of the present invention, reference should be had to the following detailed description taken in conjunction with the drawings, in FIG. 1 is a side elevational view illustrating a plurality of new and improved architectural building blocks constructed in accordance with the features of the present invention laid up in a wall structure.

DETAILED DESCRIPTION OF PREFERRED EMBODIMENTS OF THE PRESENT INVENTION

Figure 2:
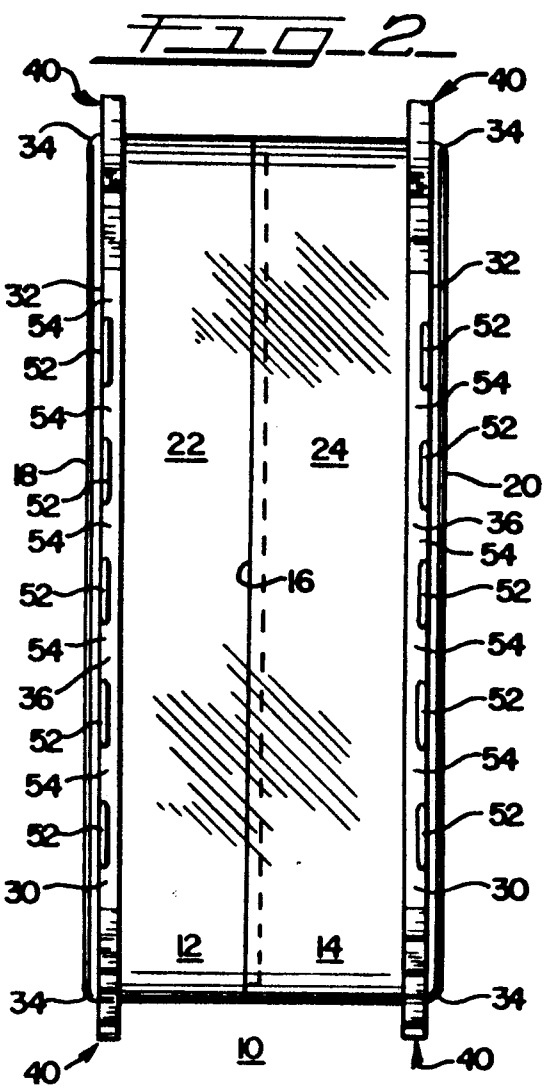
FIG. 2 is a transverse cross-sectional view taken substantially along lines 2—2 of FIG. 1.

Referring now more particularly to the drawings, therein is illustrated a new and improved architectural building block formed of light transmitting, molded plastic material constructed in accordance with the features of the present invention and indicated generally by the reference numeral 10.

The building block 10 is formed of light-transmitting, molded plastic material in an injected molding process and includes a pair of halves or half members 12 and 14 which are substantially identical except for structure forming a seam joint 16 spaced intermediately between and parallel of a pair of opposite outer side faces 18 and 20 of generally rectangular shape such as a square, rounded at the corners as shown. Each half member 12 and 14 includes an integrally molded, continuous peripheral edge wall 22 and 24, respectively, joined around the periphery of the side face 18 or 20 of the block 10 and extending inwardly thereof to a free inner edge forming a seam joint 16 as best shown in FIG. 2.

Figure 6:
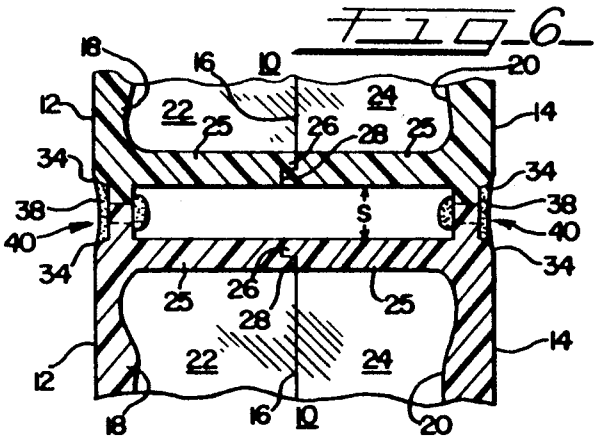
FIG. 6 is an enlarged transverse cross-sectional sectional view taken substantially along lines 6—6 of FIG. 3.

Along the inner free edge, each continuous peripheral edge flange 22 or 24 includes a tongue element 26 adapted to seat in a groove 28 formed on an opposite half member so that when the two members are assembled together as shown in FIG. 6, a complete hollow enclosure is formed and the interior of the block 10 may be sealed off against the entry of outside environmental elements when desired.

The tongue and groove joint is formed along the seam line 16 midway between the opposite outer side faces 18 and 20 of the block 10 and can be made water and vapor tight by a chemical bond, a sonic weld, an epoxy bond or silicon vapor seal. As will be described hereinafter, unsealed units may be utilized with decorative internal lighting or other types of displays. The bond provided along the seam joint 16 provides physical strength resulting in an exceedingly strong hollow block enclosure.

Figure 1:
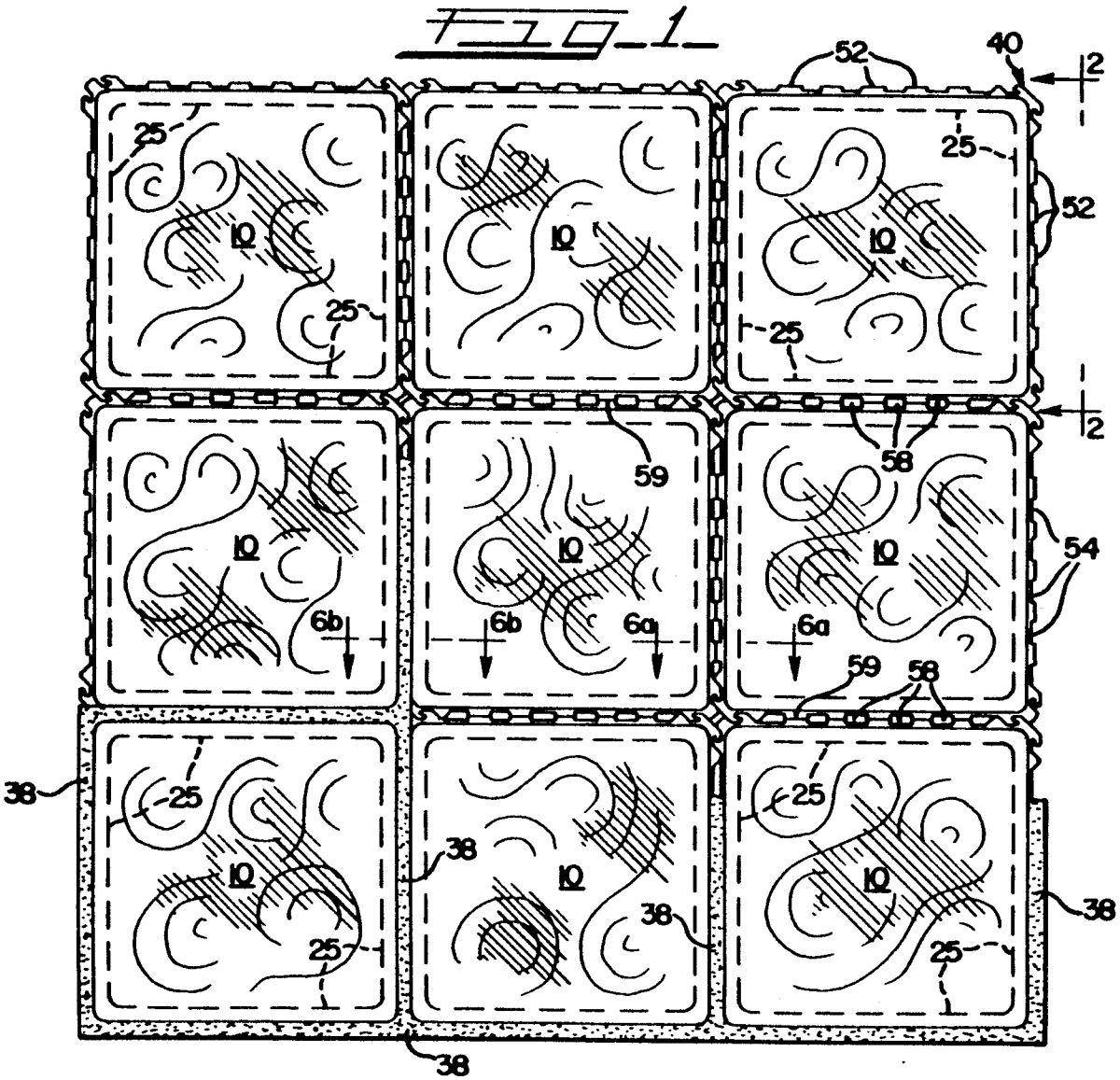

As illustrated in FIG. 1, the decorative architectural building block 10 has rounded corners and the side faces 18 and 20 have a polygonal shape as illustrated, with a preferred shape being square as shown. The continuous periphery of each block 10 comprises a plurality of pairs of planar wall segments 25 which angularly intersect at the corners of the block. These wall segments 25 make up the continuous inwardly extending peripheral side walls 22 and 24 of the respective hollow half members 12 and 14. On each half 12 and 14 there is provided an outwardly projecting, integrally formed peripheral rib or ridge 30 that is spaced inwardly of the outer surface of a respective side face 18 or 20 and formed of a generally rectangular transverse cross-section as best shown in FIGS. 2 and 6.

Each rib 30 has an outwardly facing side edge 32 which joins into a rounded transition or corner 34 blending into the adjacent planar side face 18 or 20 of a respective half member 12 or 14. Each rib also includes a wide face 36 parallel of an outer face of the respective peripheral edge walls 22 and 24. When a plurality of blocks 10 are assembled together as shown in FIGS. 1 and 3–5, the rib faces 36 are maintained in a selected parallel spaced apart relation designated by the letter "S". When the blocks are assembled together the spacing "S" between the ribs 30 provides a nice, smooth, even dimensioned joint for or a fluidized, adhesive, silicone sealant 38 applied with a caulking gun after assembling the blocks 10 together to form a building wall or other structure.

In accordance with the present invention, for the purpose of assembling of the blocks into a wall structure and for positively securing the blocks in a correct position while maintaining an accurate and even, parallel spacing "S" between the ribs 30 and wall segments 25 of adjacent blocks, each block 10 is provided with a plurality of snap lock connectors 40 integrally formed on the respective half members 12 and 14 adjacent the corners formed by intersecting pairs of planar wall segments 25.

Figure 4:
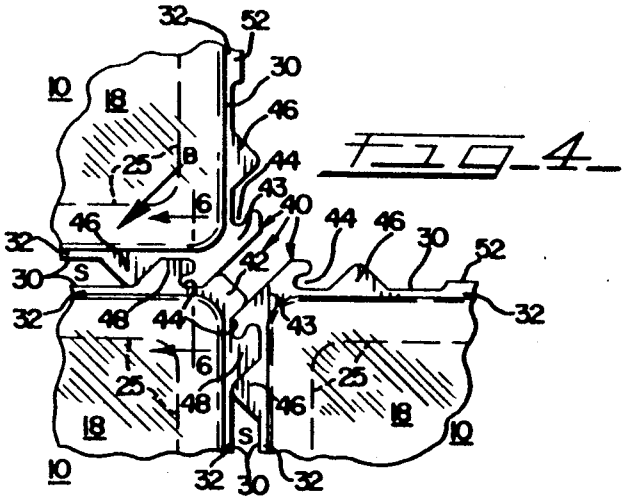
FIG. 4 is a greatly enlarged, fragmentary elevational view blocks interconnected together.
Figure 3:
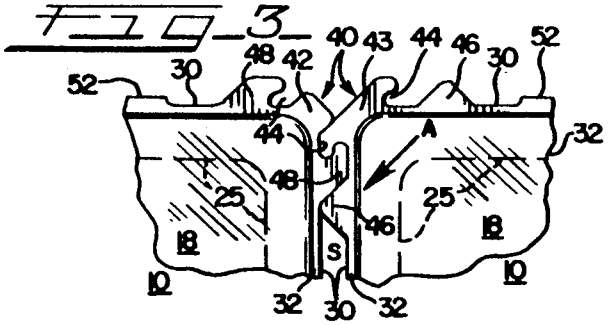
FIG. 3 is a greatly enlarged, fragmentary elevational view pair of blocks interconnected together.
Figure 5:
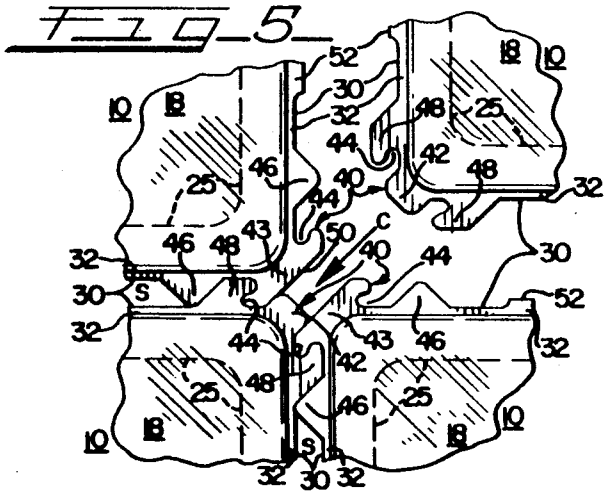
FIG. 5 is a greatly enlarged, fragmentary elevational view of three blocks interconnected together and a fourth block ready to be interconnected therewith by move in the direction of the arrow; c

As shown in enlarged detail in FIGS. 3, 4 and 5, each snap lock connector 40 includes a central tongue 42 or 43 flanked on both sides by a pair of grooves 44 formed between the tongue and a triangularly shaped spacer 46 or a finger 48. The tongues 43 have outwardly extending ears on opposite sides designed to snap fit into grooves 44 of adjacent blocks and the fingers 48 have a single ear adapted to snap fit into a groove 44 adjacent a tongue 43 on an adjacent block 10.

A pair of the narrower tongues 42 are provided on diagonally opposite corners of each half member 12 and 14 of a block 10 and a pair of the tongues 43 having ears on opposite sides are provided on the other diagonally opposite corners. Referring to FIG. 3, the left hand ear on the tongue 43 on the upper left hand corner of the right hand block 10 is snap fitted into the groove 44 on the upper right hand side of the left hand block 10, by diagonal movement of the right block downward and toward the left hand block as indicated by the arrow A. After the right and left hand blocks 10 are assembled together as shown in FIG. 3, a third upper block 10 as shown in FIG. 4 is snap fitted into interconnection with the left hand block 10, by downward and leftward movement as indicated by the arrow B. As this occurs, the right hand ear on the lower right hand tongue 43 of the upper block 10 is seated in the groove 44 on the right hand end of the upper side of the lower left hand block 10.

Referring to FIG. 5, with the lower three blocks 10 snappingly interconnected together as described, a fourth upper right hand block 10 is then assembled with the lower three by downward and left hand movement as indicated by the arrow C. As this occurs, the tongue 42 at the lower left hand corner of the fourth block 10, slide into a groove 50 formed between outer end faces of the tongues 43 of the respective upper left hand and lower right hand blocks that have already been connected together. At the same time, the fingers 48 on the fourth block 10, snappingly interfit into respective grooves 44 on the upper left hand and lower right hand blocks 10 as shown in FIG. 5. Thus, the four blocks 10 are positively interconnected together in a rapid and accurate fashion and a precise amount of space "S" is provided between the rib 30 of the adjacent, interconnected blocks. Because the ribs 30 extend around the periphery of the blocks 10 and are closely aligned with the spaced apart front and back outside wall faces 18 and 20 of the blocks, an extremely strong and lightweight wall structure is provided and precision alignment is assured without the need for the skilled labor of a journeyman brick or stone mason that is required for conventional glass blocks or glass bricks.

The snapblock connectors 40 at the corners of the blocks 10, serve in a dual capacity of (1) positively interconnecting the blocks together with (2) precision, parallel spacing "S" provided between segments of the ribs 30 on adjacent facing wall sections 25 of adjacent blocks.

In accordance with the present invention, each rib 30 is provided with a row of longitudinally spaced, backing flanges 52 having a width less than that of the flange outer faces 36 as best shown in FIG. 2. The flanges 52 are spaced between the snap fit connectors 40 at the corners of the block and spaces 54 are provided between adjacent ends of adjacent flanges along a row so that when the blocks are snap fitted together as shown in FIG. 1, openings 58 are formed to permit penetration of a fluid adhesive caulking material to the inside surfaces of the ribs 30 and flanges 52. In addition, the flanges 52 have a height that is dimensioned so as to provide a slight crack or opening 59 between the blocks 10 intermediate the openings 58 in order to provide for continuous flow of adhesive sealant along adjacent ribs 30 of adjacent blocks 10 from corner to corner.

Figure 6B:
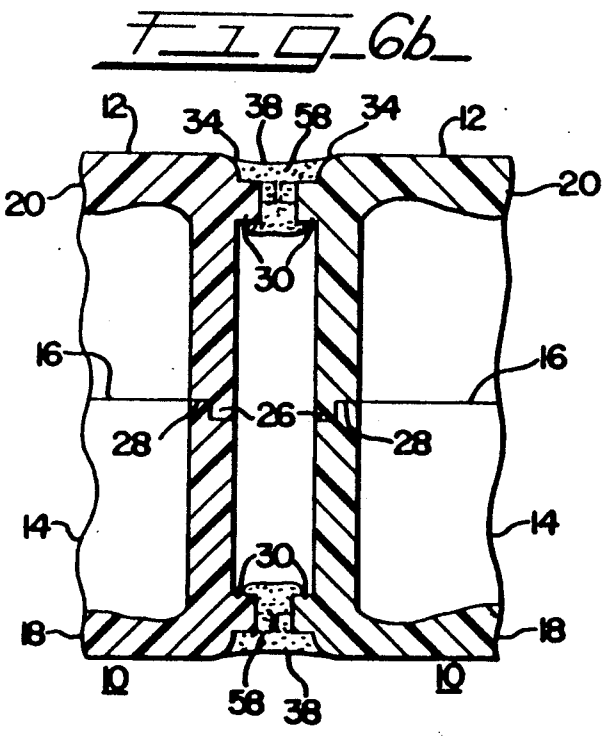
FIG. 6*b* is an enlarged transverse cross-sectional view taken substantially along lines 6*b*—6*b* of FIG. 3.
Figure 6A:
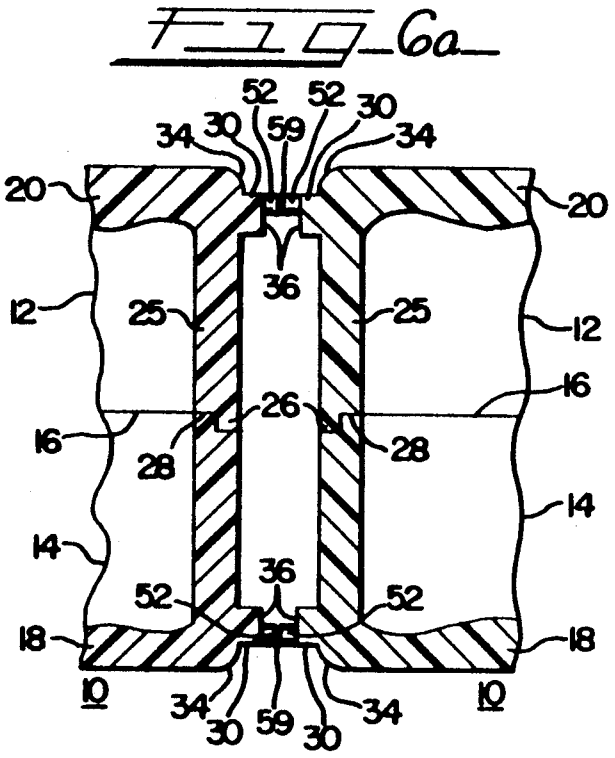
FIG. 6*a* is an enlarged transverse cross-sectional sectional view taken substantially along lines 6*a*—6*a* of FIG. 3.
Figure 7:
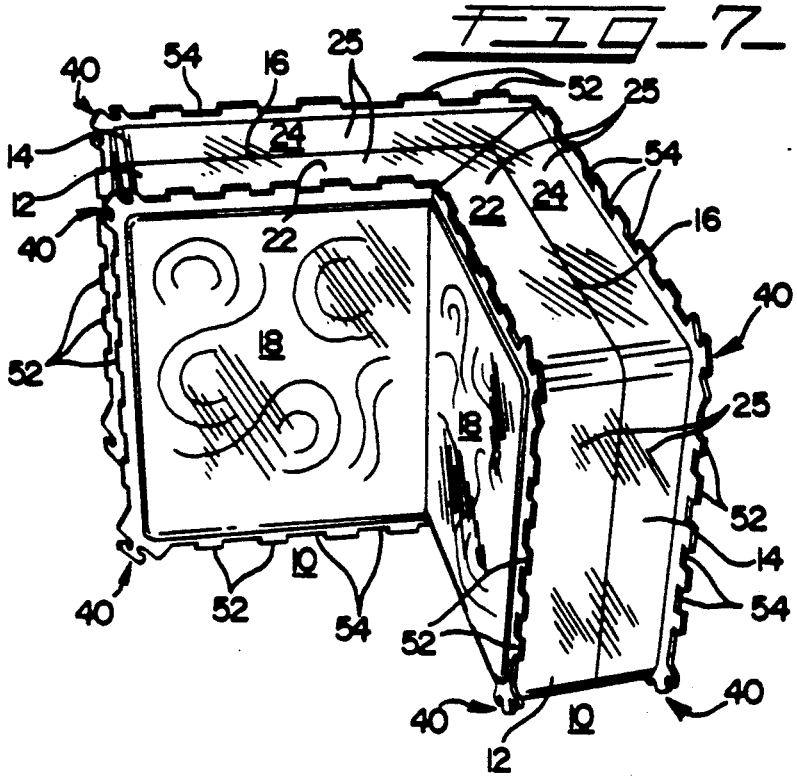
FIG. 7 is a perspective view of a pair of blocks assembled together to form an inside right angle corner of a wall structure.
Figure 8:
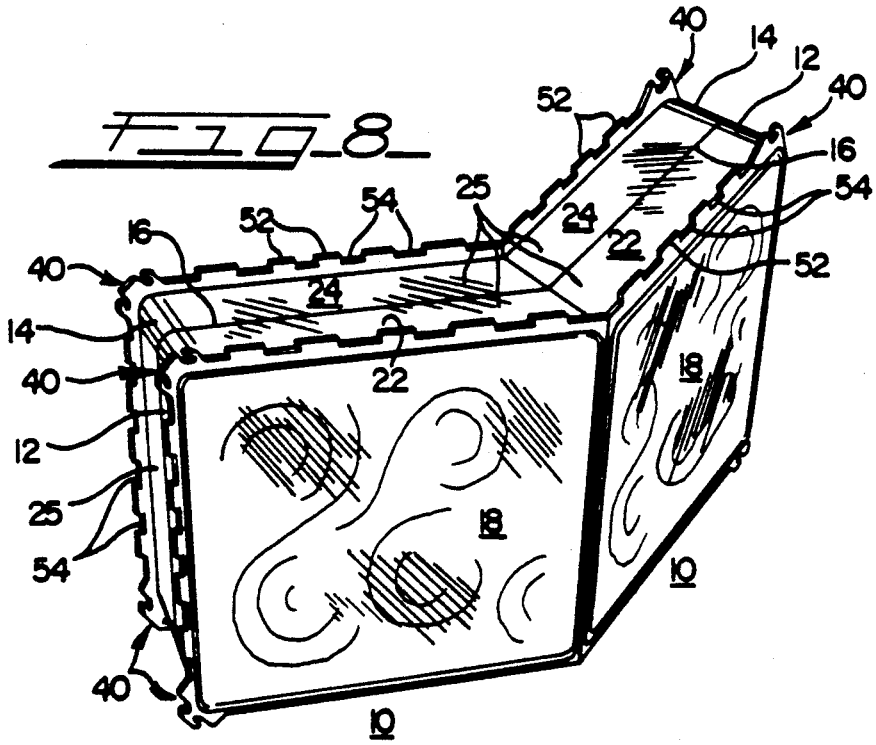
FIG. 8 is a perspective view of a pair of blocks assembled together to form an outside oblique angle corner of a wall structure.

This arrangement provided exceptional strength to adhesively bond the blocks 10 together after snap lock assembly has been completed, while at the same time reducing the volume or amount of fluid adhesive sealant that is required to form a strong adhesive bead 38 (FIGS. 6 and 6*b*) that resembles a typical mortar joint from the outside. Referring specifically to FIG. 6*b*, the bead 38 of adhesive caulking and sealant material penetrates the openings 58 and slots 59 between adjacent blocks 10 laid up in a wall structure and provides an exceptionally strong joint that greatly surpasses the holding power of a typical cement or mortar joint now used with glass blocks or bricks. In fact, little or no adhesion is effected between the mortar or cement and the surface of glass blocks or bricks, whereas the blocks 10 are formed of plastic material which is adhered to by the sealant material of the beads 38 applied with a caulking gun from the outside. Thus the blocks 10 provide for a mechanical interconnection between adjacent blocks through the snap fit connectors 40 and an adhesive connection between blocks via the adhesive sealant beads 38.

A silicone sealant and filler known as RTV filler in white or grey or other colors, may be utilized to provide a fast, strong adhesive interconnection between edge portions of adjacent blocks 10 and to provide a weather-tight seal similar to a mortar joint. The silicone filler strip 38 may be laid in place with a common caulking gun or by a tool such as a spatula-like or spoon-like instrument.

In accordance with the present invention, the unique architectural building blocks 10 are formed in a low stress injection molding process wherein internal stresses remaining in the blocks after manufacture are maintained below 1500 psi or less and wherein at least one of the molded outer side faces 18 or 20 has an optical quality, surface finish. Plastic resins such as a polycarbonate resin or acrylic resin is injected into a precision, highly polished, metal mold while in a liquid state at a relatively high temperature and is cured to a solid state while still remaining within a mold cavity.

The resin used is injected into the mold at an initially high injection pressure of up to 60,000 psi and a vacuum is applied to the mold cavity in order to rapidly draw the resin into the mold cavity while the cavity surfaces are maintained at a relatively high temperature so as to preclude premature skin formation or crusting of the resinous material as it first enters and fills the mold cavity. This arrangement insures that a completely filled mold cavity is rapidly achieved in an injection operation. The molded resin of the half members 12 and 14 is cured in a relatively short period of time while the members are still retained in the mold cavity and thereafter, when the mold is opened and the half members removed therefrom, additional annealing processes are not required for further reducing internal stresses. By elimination of most or all of the mold or process induced internal stresses in the half members 12 and 14 of a block 10, the outer surface thereof is more readily bondable with a thin, tough, hard, clear coating of abrasion resistant, polycyloxine resin, and/or an ultra-violet (UV) curable resin layer or protective coating applied by flow coating, dipping or spraying.

An abrasion resistant, glossy appearing, clear, protective coating surface layer is applied in a processing environment having a high degree of cleanliness and precise humidity control, preferably in a relative humidity range of between 35% to 50%. A suitable curing time is provided to insure an exceptionally clear and hard outer surface coating that is permanently bonded onto the optical quality surfaces 18 or 20 of the block 10, which block is formed with a low stress, injection molded, resin. The resulting block is extremely pleasing in appearance and very closely resembles and/or simulates glass blocks or glass bricks while at the same time providing many distinctive advantages over glass.

In accordance with the present invention, the half members 12 and 14 are preferably constructed of injection molded polycarbonate or acrylic, plastic resin and these resins are chosen because of their clarity and high light transmission capability. Moreover, these resins have a relatively low thermal conductivity, high impact strength, are relatively low cost, and have an excellent ability to withstand ultraviolet light and weather exposure for long periods of time without substantially discoloring, crazing or cracking, even when subjected to a relatively high degree of physical abuse.

The resins are molded in a low stress, high temperature injection molding process as described hereinafter wherein the finished molded half members 12 and 14 have very low permanent internal stresses, typically ranging between 400 psi and 1500 psi after manufacture and final curing is completed. Preferably the internal stresses developed in the resinous material while flowing into the mold and during the molding process is maintained at a level of 1500 psi maximum or below.

In order to produce these low stress molded members 12 and 14, the resin is injected into the mold cavity at or near a high temperature limit as recommended by the resin manufacturer. For example, when polycarbonate resin is utilized, a temperature of 600° to 610° F. is used to increase fluidity and assist in the flow of the resin material across the mold cores and into the cavities of the mold. Initial injection pressure at the inlet of the mold may be as high as 60,000 psi with a range of 30,000 psi to 60,000 psi preferred so as to rapidly deliver the needed quantity of resin to fill the mold cavity in an extremely short period of time, for example, about one or two seconds.

In addition, while the injection molding process takes place, the mold cavity ahead of the flowing resin is being evacuated by means of a vacuum pump so that the liquid resin is both pushed and pulled rapidly into the mold cavity. A vacuum range in the order of 27 to 28 inches of mercury below atmospheric is preferably maintained from a suction line connected between the mold cavity and a vacuum pump.

The resin is cured while retained within the mold cavity during a 25 to 45 second time interval after mold filling is completed. The curing time required is dependent upon the wall thickness of the half members 12 and 14 being molded. When relatively thick ribs or wall sections are needed, additional curing time in the mold cavity is provided; for example, 60 to 90 seconds may be required. Additional curing time of up to 4 hours at a temperature range of 220°-240° F. and a dew point temperature of −20° F. may also be provided when necessary.

The combination of high initial resin temperature, (575°-610° F.), high mold surface temperatures (200° F.-230° F.) in the entry portion of the mold cavity and high initial injection pressure is extremely important in producing a final low internal stress condition in the finished molded blocks 10.

In the past, conventional injection molding processes often resulted in relatively high internal stresses being developed in molded plastic articles; sometimes in excess of 2,500 psi. With stresses at this high level, the quality of adhesion between these molded plastic articles and hard surface coatings applied thereto was low, resulting in the formation of micro-cracks in the coating layer and delamination between the resin substrate and the outer coating layer when subjected to normal thermal cycling between −40° F. and +160° F.

These tendencies to form micro-cracks in the outer coating layer and delamination of the outer coating layer from the molded underlying plastic resin substrate is believed to be a result of the relatively high internal stress levels produced in the base substrate in a conventional molding operation. When thermal cycling occurs, the high level of internal stress results in a substantial movement of the base resinous substrate which tends to foster micro-cracking and delamination. In order to reduce this tendency, it was often necessary to post anneal prior articles in another secondary operation which is costly and time consuming. Moreover, typical annealing processes have a wide range of variables and inconsistency results unless highly accurate control is provided, which again is costly and time consuming.

The relatively low levels of process-induced, internal stress provided in the molded plastic substrated produced in accordance with the teachings of the present invention, result in a greatly improved permanent adhesion between the substrate surface and the hard protective outer coating layer, and expensive and time consuming post annealing operations are eliminated altogether. In the past, it was common to provide a post annealing process in order to reduce internal stress down to levels of approximately 750 psi in the substrate and the elimination of this costly and difficult to control secondary operation is a great economic incentive provided by the present invention.

In accordance with the invention, after the half members 12 and 14 are molded in the manner described to insure a low level of process induced internal stress of 1500 psi or less, and after a final curing of the members is completed forming an optical quality surface finish on the outer side faces 18 and 20, a thin, clear, light transmitting, abrasion resistant, ultra-violet light resistant, relatively hard, protective coating or layer of plastic resin is applied to the outer surface of the substrate. This thin outer protective layer may reach a maximum thickness of up to 1 mil and adheres to the surface of the substrate to form a permanent bond against later delamination. The protective layer is cured by the passage of the half members 12 and 14 under a heat lamp and in a typical operation, the members may move at a velocity of 15 to 30 feet per minute past the heat lamp so that surface temperatures of 220° F. to 240° F. are present on the thin, hard, outer protective layer or coating.

The hard surface protective layer or coating provides excellent abrasion resistance and excellent resistance to deterioration of the blocks 10 and the substrate thereof when prolonged exposure to the weather and/or ultraviolet light is experienced. Moreover, molded plastic blocks 10 produced in the aforementioned method, are well able to resist delamination between the substrate and outer protective coating layer.

Typically a suitable outer protective layer comprises a polycyloxine resin which is applied to the cured substrate in a flow coating, dip coating or spray coating operation so that the resulting outer side faces 18 and 20 assume a high gloss, hard finish which closely resembles a common glass block. Moreover, to the untrained eye, it is often difficult to ascertain that the blocks in accordance with the present invention are not actually glass blocks of a prior era.

In accordance with the present invention, one or both of the half members 12 and 14 of a block 10 can be easily tinted to the shade or color desired by the introduction of tinting material into the molding resin of the substrate prior to or during the molding process. The tinted members offer improved thermal efficiencies and reduce the transmission of light. The tinting shades may be of a type that especially reduces harmful infrared and UV range radiation through the block faces 18 and 20. Polycarbonate and acrylic substrates, can be easily and economically tinted to make architecturally pleasing shades such as bronze, grey, white etc. and these shades and colors may provide a permanent decorative alternative to clear glass.

In addition to cosmetics, there are two other areas of advantages afforded in tinted blocks 10. The tinting feature provides excellent security to a person inside a wall of blocks 10 by offering viewing to the outside, while at the same time providing obscurity when an intruder looks inside, because of the light transmission reduction of the tinted side faces (20%-60%). A person can easily observe a would-be intruder's activity through a tinted block wall.

Block 10 of polycarbonate resin provide superior vandal and intruder resistance so that damage is minimized or eliminated because the blocks are virtually unbreakable under normal impact. Security from damage by small caliber firearms is also provided in block wall construction using blocks 10 having a 3/16" outer side face thickness and/or a ⅛" side face thickness on an inside wall surface.

Architectural and security tints offer reduced light transmission of harmful sunlight containing infrared and UV ranges of light with the effect of retaining heated or cooled air on the desired side of a structure or wall. This feature provides economy through heating and cooling cost reductions and in certain circumstances protects against sun damage to interior furnishings and fixtures.

The safety and security features of the new blocks 10 provide new architectural freedom in areas previously declared as unsafe or hazardous and offer a great improvement in installations wherein glass breakage is a hazard such as in shared dwellings, townhouses, condominiums, public buildings and common use entryways.

Control of resin melt and flow can maintain stress levels below 1000 psi in a molded transparent substrate of the blocks 10 in accordance with the invention. Low stress levels optimize the physical properties of the substrate and offer improved adhesion of secondary coatings such as paint and abrasion resistant coatings. These low stress levels significantly reduce expansion and contraction of a molded substrate due to extremes in thermal cycling.

There are three basic manufacturing elements used to accomplish low stress injection molding: (1) high quality steel injection molds, (2) microprocessor controlled, closed loop molding machines, and (3) molding resin/-base substrates of acrylic or polycarbonate that are certified by the manufacturer of the resins to meet a narrow range of manufacturing specifications.

High quality pre-tempered 32-34 RC steel is used to provide optical quality surface finishes, for optimizing at 84%-94% the amount of light transmission for acrylic and polycarbonate molding resin of the block half members 12 and 14.

Thermal control of mold core and cavity plates is provided to evenly control and distribute mold surface temperature, and cooling lines are installed radially or in a cross hatch pattern over the mold surfaces. Monitoring of mold surface temperatures is conducted by thermocouples that are installed beneath the mold core and the cavity surfaces and which interfaced with a molding machine process controller. Control of cooling water flow and temperature is provided with temperature controllers having two (2) to four (4) units per mold half. Each controller is interfaced with an injection molding machine microprocess controller.

Venting of the mold plates is utilized to evacuate cavity air pressure from the resin injection fill and is accomplished by a vacuum venting process utilizing a vacuum venturi and interfacing same with an injection machine microprocess controller. The fill speed of the resin is timed to the evacuating speed of cavity pressure build from the fill in order to eliminate/minimize flow front pressures. Microprocessor monitored pressure transducers are placed on each mold half to monitor pressure at critical flow length points to assure a balance of mold fill and low pressure requirements.

The blocks 10 are manufactured in molding machines which include a microcomputer that interfaces with a hydraulic system, an injection mechanism, a mold clamping unit and an injection type, high quality mold. The microcomputer monitors and controls each of the key functions of the molding process and utilizes information received from the injection mold via thermocouples, pressure transducers and the vacuum venturi. Various international manufacturers of suitable molding machines include Engel Machinery located in Guelph, Ontario, Canada.

Control of the resin used in making the blocks 10 is essential to maintain desirable physical properties and optical appearance. Only minimum amounts of release agent are required insure minimum adhesion and distortion of the glass-like surfaces of the molded block 10. A suitable polycarbonate resin is manufactured by the Mobay Chemical Company located in Pittsburgh, Pennsylvania, and by the General Electric Company located in Pittsfield, Mass. A suitable acrylic resin is manufactured by Rohm & Haas in Philadelphia, Penna., Continental Polymers in Los Angeles, Calif., and Cyro Plastics in Mount Arlington, N.J.

Abrasion resistant clear protective coats for the half members 12 and 14 are applied as a secondary operation by means of flow coating, dip coating or spray coating. Special custom coating equipment is utilized and in addition, the process environment requires cleanliness and humidity control (Class 100 and 35%-50% relative humidity). Close control of cure time and film build on coating thickness is extremely important to maintain a proper adhesion and abrasion resistance on the plastic resins of the basic half members 12 and 14.

The abrasion resistant coatings used on the blocks 10 include polysiloxanes and UV curables. These materials provide a glass-like hardness to an otherwise soft acrylic or polycarbonate surfaces of a half member 12 or 14. In addition to abrasion resistance, major protection is provided for resistance to chemicals and protection from ultraviolet sunlight or UV emitting lamps/-lights.

No standard type of equipment generally exists today made especially for the application of protective coatings for the blocks 10, however, suitable coating application units are manufactured by Thierica Inc., Grand Rapids, Mich. and the Rockwell Corporation, Fairfield, Conn.

Tinting of the basic resins of the blocks 10 or tinting of the protective coating layer provides considerable security when the blocks are used in an outside wall installation. For example, during daylight hours, easy viewing to the outside is relatively constant, whereas, viewing from the outside inwardly may be reduced by 60%-80%.

Security against damage or breakage from small caliber firearms is exceptional as a thick section of polycarbonate on a side face 18 or 20 of a block 10 reduces bullet penetration significantly and/or may eliminate penetration altogether thereby significantly reducing the possibility of life loss.

The blocks 10 also have a high impact resistance against general vandal abuse resulting from thrown rocks, bottles, bats, etc. Significant damage because of cracking or shattering is almost eliminated, thus allowing blocks 10 to be installed in areas previously declared unsafe or hazardous. The blocks are especially useful in public housing or commercial buildings such as warehouses, parking garages, etc.

Coloring and tinting of the blocks 10 offers reduced light transmission from the harmful sunlight, infrared and ultraviolet light bands to the effect that heated air or cooled air can be better retained on the side of an installation where desired, along with a better quality rejection of heat or cold from an opposite side due to the reduced heat and light transmittance through the tinted walls of the blocks 10. This feature provides economy through heating and cooling cost reductions and protects against sun damage to interior furnishings and fixtures.

Many modifications and variations of the present invention are possible in light of the fore-going specification and thus, it is to be understood that within the scope of the appended claims, the invention may be practiced otherwise than as specifically described.

What is claimed and desired to be secured by Letters Patent of the United States is:

1. An architectural building block formed of light transmitting, molded material to resemble a common glass block, comprising:

a plurality of hollow half members joined together along a seam to form a hollow block enclosure with said seam spaced intermediately between a pair of opposite outer side faces of said block, each half member having an inner surface and an outer surface comprising one outer side face of said block of polygonal shape integrally joined around its periphery to an inwardly directed continuous peripheral edge wall having a plurality of angularly intersecting wall segments normal to said outer side face and a continuous free edge providing one joining edge of said seam;

flange means formed along at least one of said wall segments aligned to extend outwardly of said side face for at least partially filling a precise amount of space established between a pair of adjacent blocks when said blocks are positioned with respective wall segments thereof in spaced apart confronting relationship for forming a wall structure including said pair of blocks; and connector means including a pair of interlockable tongue and slot forming elements integrally formed and aligned on said flange means of said respective blocks for detachably securing said adjacent blocks together.

2. The architectural building block of claim 1, wherein:

said connector means includes tongue and slot elements projecting outwardly of said for detachable interconnection with a slot and tongue of an adjacent block to maintain said space between said adjacent facing wall segments of said blocks.

3. The architectural building block of claim 2, wherein:

said tongue of a connector means on one block is adapted to snap fit into a slot of a connector means of an adjacent block.

4. The architectural building block of claim 3, wherein:

said tongues and slots slope angularly outwardly of said planar wall segments.

5. A plurality of architectural building blocks as set forth in claim 2, having said connector means thereof interconnected, wherein:

said tongues of one pair of interconnected blocks together form a slot for receiving the tongue of another block.

6. A plurality of architectural building blocks as set forth in claim 5, wherein:

said tongues of said one pair of inter-connected blocks are spaced apart by tongues of another pair of said blocks.

7. A plurality of architectural building blocks as set forth in claim 6, wherein:

said slot formed by said tongues of said one pair of interconnected blocks is aligned to extend angularly outwardly of facing adjacent corners of said other pair of blocks.

8. The architectural building block of claim 1, wherein:

said flange means comprises a plurality of flange segments spaced apart in a row along said wall segment providing spaces between adjacent segments in said row for receiving liquid adhesive joining material.

9. An architectural building block formed of light transmitting, molded plastic material resembling a glass block, comprising:

a par of rectangular-shaped halves adapted to be joined together along a peripheral sam to form a hollow building block with said seam spaced intermediately between parallel, opposite, outside wall faces of generally rectangular shape, each of said halves including an inner surface and an outer surface comprising one of said outside wall faces and a peripheral edge wall integrally joined to an outer peripheral edge of said outside wall face, said peripheral edge wall having an inner peripheral edge forming one joining edge of said seam and comprising a plurality of pairs of parallel, planar walls segments intersecting to form corners of said block;

integrally formed spacer means on said intersecting wall segments for maintaining a spaced apart parallel relation with an adjacent wall segment of an adjacent block, said spacer means including connector means for detachably interconnecting and securing said adjacent blocks to retain said adjacent wall segments in said spaced apart parallel relation.

10. The architectural building block of claim 9, including:

integral flange means aligned along said wall segments projecting outwardly thereof and inset from said outer surface of outside wall for reducing open space between adjacent wall segments of adjacent blocks laid up in a structure.

11. The architectural building block of claim 10, wherein:

said flange means comprises a plurality of flange segments aligned in a row with spaced openings between said segments for permitting fluid adhesive material applied in a joint between said adjacent blocks to penetrate to an inside face of said flange segments for securing said adjacent blocks together.

12. The architectural building block of claim 11, wherein:

said flange segments have an outer edge spaced outwardly of an adjacent wall segment by an amount providing for an opening between said outer edge and an adjacent outer edge of said adjacent block for permitting said fluid adhesive material to penetrate between said outer edges of said adjacent blocks for securing said blocks together.

13. The architectural building block of claim 9, including:

flange means on each of said wall segments projecting outwardly thereof and spaced inwardly of said outer surface of said outside wall for providing a backing surface between adjacent wall segments of adjacent blocks positioned with said adjacent wall segments in spaced confronting relation in a structure including said adjacent blocks for receiving a fluid adhesive material applied to securing said blocks together.

14. The architectural building block of claim 13, wherein:

said flange means comprises a plurality of flange segments aligned in a row with spaced openings between said segments for permitting fluid adhesive material applied in a joint between said adjacent blocks to penetrate to an inside face of said flange segments for securing said adjacent blocks together.

15. The architectural building block of claim 14, wherein:

said flange segments have an outer edge spaced outwardly of an adjacent wall segment by an amount providing for an opening between said outer edge and an adjacent outer edge of said adjacent block for permitting said fluid adhesive material to penetrate between said outer edges of said adjacent blocks for securing said blocks together.

16. The architectural building block of claim 9, including:

detachable snap lock connector means on said wall segment for interconnecting adjacent blocks in a wall structure.

17. The architectural building block of claim 16, wherein:

said connector means are positioned adjacent said corners inset from said outer surface of said outside wall face.

* * * * *

UNITED STATES PATENT AND TRADEMARK OFFICE

CERTIFICATE OF CORRECTION

PATENT NO. : 5,033,245

DATED : July 23, 1991

INVENTOR(S) : JAMES R. KLINE

It is certified that error appears in the above-identified patent and that said Letters Patent is hereby corrected as shown below:

Col. 11, line 38, after "molded" insert -- plastic --;

line 44, after "and" insert -- having --;

Col. 12, line 40, "par" should read -- pair --;

line 41, "sam" should read -- seam --;

line 51, "walls" should read -- wall --.

Signed and Sealed this

Twenty-second Day of December, 1992

*Attest:*

DOUGLAS B. COMER

*Attesting Officer*

*Acting Commissioner of Patents and Trademarks*